US007784974B2

(12) United States Patent
Baechtiger et al.

(10) Patent No.: US 7,784,974 B2
(45) Date of Patent: Aug. 31, 2010

(54) DEVICES AND METHODS FOR PROVIDING ADJUSTABLE LIGHT INTENSITY

(76) Inventors: Walter Baechtiger, 107 Stonetree La., Novato, CA (US) 94945; Kyle Hickey, 10597 Butte Dr., Longmont, CO (US) 80504

( * ) Notice: Subject to any disclaimer, the term of this patent is extended or adjusted under 35 U.S.C. 154(b) by 78 days.

(21) Appl. No.: 11/977,361

(22) Filed: Oct. 24, 2007

(65) Prior Publication Data

US 2008/0100413 A1 May 1, 2008

Related U.S. Application Data

(60) Provisional application No. 60/856,685, filed on Oct. 31, 2006.

(51) Int. Cl.
*F21L 4/04* (2006.01)

(52) U.S. Cl. ..... 362/295; 362/205

(58) Field of Classification Search ..... 362/198–203, 362/205, 295

See application file for complete search history.

(56) References Cited

U.S. PATENT DOCUMENTS

| | | | | |
|---|---|---|---|---|
| 4,700,172 | A | 10/1987 | Ishida et al. | |
| 4,950,963 | A | 8/1990 | Sievers | |
| 5,162,775 | A | 11/1992 | Kuramochi | |
| 5,376,913 | A | 12/1994 | Pine et al. | |
| 5,764,316 | A | 6/1998 | Takizawa | |
| 5,876,106 | A | 3/1999 | Kordecki | |
| 6,951,410 | B2 | 10/2005 | Parsons | |
| 7,084,360 | B2 | 8/2006 | Schmidt | |
| 7,190,251 | B2 | 3/2007 | Schrum | |
| 7,220,016 | B2 | 5/2007 | Matthews | |
| 7,235,754 | B2 | 6/2007 | Rochon | |
| 7,410,269 | B2 * | 8/2008 | Harrity et al. | 362/101 |
| 7,629,871 | B2 * | 12/2009 | Schrum et al. | 338/69 |
| 2002/0067606 | A1 | 6/2002 | Wang | |
| 2005/0265035 | A1 | 12/2005 | Brass | |
| 2007/0176714 | A1 | 8/2007 | Potempa | |
| 2007/0201224 | A1 | 8/2007 | Neckels | |

* cited by examiner

*Primary Examiner*—Anabel M Ton

(57) ABSTRACT

The present invention generally relates to light sources that have variable and adjustable luminous intensities. According to certain preferred embodiments of the invention, devices are provided that generally comprise (1) a conductive elastomeric material that is located between a first and second conductive surface; (2) a power source operably connected to the first conductive surface; and (3) a light source operably connected to the second conductive surface. In such embodiments, the conductive elastomeric material comprises an electrical resistance that decreases when the material is compressed or contacts a greater surface area of the first or second conductive surface. By modulating the compression state of the elastomeric material (and, therefore, the ohmic resistance thereof), the amount of electrical power transmitted from the power source to the light source is controlled, which in turn affects the luminous intensity of the light emitted therefrom.

20 Claims, 3 Drawing Sheets

DEVICES AND METHODS FOR PROVIDING ADJUSTABLE LIGHT INTENSITY

CROSS-REFERENCE TO RELATED APPLICATIONS

This application claims priority to, and incorporates by reference, U.S. provisional patent application Ser. No. 60/856,685, filed on Oct. 31, 2006.

FIELD OF THE INVENTION

The field of the present invention relates generally to adjustable lighting devices and appliances. More particularly, the present invention relates to methods and devices for providing light sources that have variable and adjustable luminous intensities.

BACKGROUND

Many applications exist for devices and methods that enable a user to selectively adjust the luminous intensity of a light source. For example, most are familiar with a wall-mounted dimmer switch, which typically employs a rheostat that may be controlled by a rotary or linear motion, in order to adjust the intensity of a light. Despite the availability of such devices (and others that are used in other applications), a need exists for improved devices and methods that enable a user to selectively adjust the luminous intensity of a light source. Preferably, the improved devices and methods will require less space, provide smooth adjustability, and be more easily and affordably integrated into different types of lighting appliances. As shown and described below, the present invention addresses many of the foregoing needs.

SUMMARY OF THE INVENTION

According to a first preferred embodiment of the invention, devices for selectively adjusting the luminous intensity of a light source are provided. Such devices generally comprise (1) a conductive elastomeric material that is located between a first and second conductive surface; (2) a power source operably connected to the first conductive surface; and (3) a light source operably connected to the second conductive surface. In such embodiments, the conductive elastomeric material comprises an electrical resistance that decreases when the material is compressed and/or contacts a greater surface area of the first or second conductive surface. By modulating the compression state of the elastomeric material (and, therefore, the ohmic resistance thereof), the amount of electrical power transmitted from the power source to the light source is controlled. Of course, modulating the amount of electrical power transmitted to the light source will serve to modify the luminous intensity of the light emitted therefrom.

According to a second preferred embodiment of the invention, additional devices for selectively adjusting the luminous intensity of a light source are provided. Such devices generally comprise (1) a conductive elastomeric material; (2) a power source; (3) a light source; and (4) a DC/DC converter circuit. In such embodiments, the DC/DC converter circuit is operably connected to and (directly or indirectly) makes contact with the conductive elastomeric material, which comprises an electrical resistance that decreases when the material is compressed in response to an axial force applied thereto (and increases when such force is removed and the material is allowed to decompress into its resting state).

According to a third embodiment of the present invention, light sources having selectively adjustable luminous intensities are provided, which employ the devices and methods described herein. Such light sources include, but are not limited to, any of various battery-operated devices, such as flashlights and other lighting appliances. In addition, the invention encompasses light sources having selectively adjustable luminous intensities, which utilize an external power source.

According to a fourth preferred embodiment of the invention, methods for selectively adjusting the luminous intensity of a light source are provided. In certain embodiments, such methods generally comprise (1) operably connecting a conductive elastomeric material between a power source and light source and (2) selectively compressing or decompressing the conductive elastomeric material. According to such embodiments, compressing the material decreases the electrical resistance thereof, whereas decompressing the material increases the electrical resistance thereof. The change in ohmic resistance of the elastomeric material is effective to further modulate the electrical power transmitted from the power source to the light source. For example, compression of the elastomeric material (and the resulting decrease in ohmic resistance) may result in more power being transmitted from the power source to the light source, which results in a higher luminous intensity. Alternatively, through the use of a DC/DC converter, compression of the elastomeric material (and the resulting decrease in ohmic resistance), may ultimately result in less power being transmitted from the power source to the light source, which results in a lower luminous intensity.

The above-mentioned and additional features of the present invention are further illustrated in the Detailed Description contained herein.

DETAILED DESCRIPTION OF THE INVENTION

Figure 1:
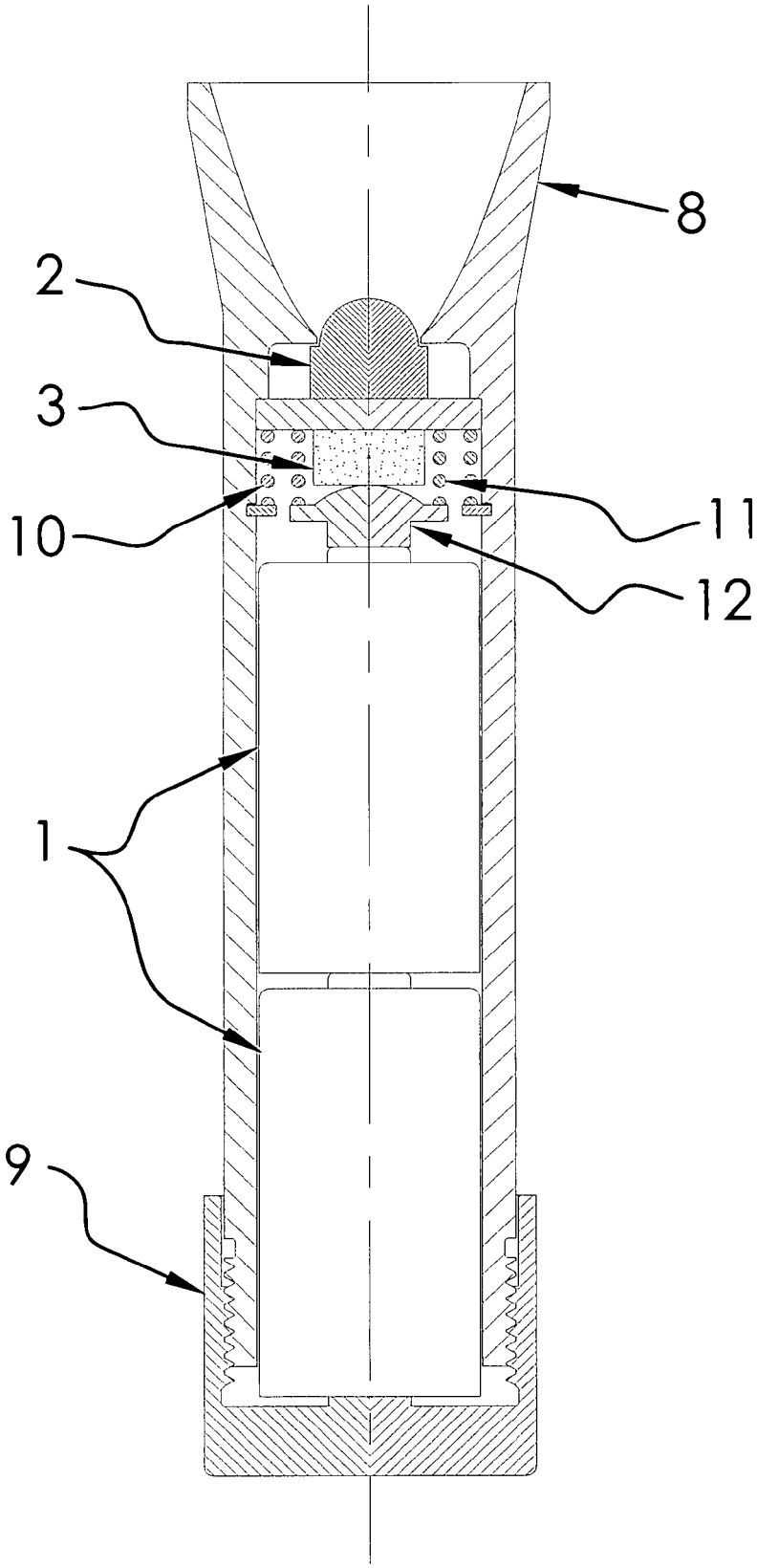
FIG. 1 is a cross-sectional view of a light emitting apparatus employing the devices and methods of the present invention.

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

According to a first preferred embodiment of the invention, devices for selectively adjusting the luminous intensity of a light source are provided. Such devices generally comprise a conductive elastomeric material that is located between a first and second conductive surface. A power source is operably connected to the first conductive surface, whereas a light source is operably connected to the second conductive surface. As used herein, the term "operably connected to" means that a first element is capable of (directly or indirectly) transferring an electric current to, or receiving an electric current from, a second element.

In such embodiments, the conductive elastomeric material comprises an electrical resistance that decreases when the material is compressed and/or contacts a greater surface area of the first or second conductive surface. Non-limiting examples of such conductive elastomeric materials include an elastomeric material, such as nitrile, silicone, rubber, or others, which is impregnated with one or more conductive components, such as carbon flakes, silver flakes, or others. More specifically, for example, the conductive elastomeric materials may comprise an elastomeric material that includes natural rubber, synthetic polyisoprene, butyl rubbers, polybutadiene, styrene-butadiene rubber, nitrile rubber, chloroprene rubber, ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, ethylene-vinyl acetate, thermoplastic elastomers, thermoplastic vulcanizates, polyurethane rubber, or combinations thereof. These elastomeric materials may be impregnated with one or more conductive metals and/or nonmetals, such as carbon, silver, copper, graphite, gold particles, or others.

Preferably, the elastomeric materials will exhibit less than 1 ohm of resistance in a fully compressed state, and a significantly higher resistance in a decompressed (resting) state. The preferred thickness of the elastomeric material may vary depending on the desired inherent ohmic resistance thereof. The present invention provides, however, that an elastomeric material that is about 0.5 mm thick, and exhibits less than 1 ohm of resistance in a fully compressed state, and a significantly higher resistance in a decompressed (resting) state, is generally preferred for many applications.

A certain preferred embodiment of the present invention is illustrated in FIG. 1. As shown therein, the device of the present invention comprises a power source (1), which may be, for example, one or more batteries, and a light source (2). In this particular embodiment, the light source (2) comprises a conductive surface or, more particularly, the terminal end of the light source (2) closest to the power source (1) comprises a conductive surface. Any suitable power source (1) may be employed, including disposable batteries, rechargeable batteries, flow batteries, battery packs, galvanic cells, electrolytic cells, fuel cells, flow cells, voltaic cells, or combinations thereof. The invention further provides that an external power source may be used in the present invention.

A conductive elastomeric material (3) is disposed between the power source (1) and light source (2). The device further comprises a plunger (12) located adjacent to the elastomeric material (3). According to such embodiments, the plunger (12) may be (wholly or partly) comprised of a conductive material, such that it may operate to transfer an electric current from the power source (1) to the conductive elastomeric material (3). Alternatively, the power source (1) may be operably connected to the conductive elastomeric material (3) through a separate circuit, such that the plunger (12) does not serve as a part of the circuit, but rather just as a means for compressing the elastomeric material (3) as described herein.

The device also includes a means for causing the plunger (12) to exert an axial force (directly or indirectly) on the elastomeric material (3), such that the elastomeric material (3) becomes compressed (i.e., the width or thickness thereof decreases). In the non-limiting example shown in FIG. 1, the device comprises a threaded knob (9), which upon rotation in a first direction causes the power source (1) to move or translate forward. Conversely, upon rotation of the knob (9) in a second (opposite) direction, the power source (1) to moves or translates backwards. In the device shown in FIG. 1, when the knob (9) is rotated in a first direction, the power source (1) moves forward, which in turn causes the plunger (12) to move forward and compress the elastomeric material (3). Of course, in certain alternative embodiments, the knob (9) may be mechanically connected to the plunger (12), such that when the knob (9) is rotated in a first direction, the plunger (12) translates forward to compress the elastomeric material (3), while the power source (1) remains stationary. It should be appreciated that other actuating means and user interfaces could be used to cause the power source (1) and/or plunger (12) to translate forward other than a rotatable knob (9), such as a ratchet mechanism. In addition, while the actuating means, e.g., the rotatable knob (9), is shown to exist at the backside of the device shown in FIGS. 1-3, it should be appreciated that the actuating means may be located in any other suitable position, such as in the middle or front portion of the device, so long as it may be operated to (directly or indirectly) increase and decrease the amount axial force applied to the elastomeric material (3).

Still referring to FIG. 1, the device shown therein further includes a set of coil springs (10) and (11). In such embodiments, the coil spring (10) operates to ensure that a low resistance path exists between the electronic circuit and the conductive housing, i.e., between and among the conductive surface (terminal) of the light source (2), the conductive elastomeric material (3), the plunger (12), and/or power source (1). The additional coil spring (11) is employed to exert a continuous axial bias force against the plunger (12)—away from the elastomeric material (3). This preloaded, axial bias force prevents residual force from acting upon the elastomeric material (3) when it is desirable to have the elastomeric material (3) in an uncompressed state. This mechanical preload is also preferred in order to ensure that the circuit operates with stability at lower power levels. Either (or both) of the foregoing coil springs may substituted with any other suitable mechanical element that is capable of applying the necessary axial force.

The device shown in FIG. 1 further includes a housing (8), which encapsulates the elements described above. The housing (8) may be comprised of any durable material, such as plastics, ceramics, steel, other metals, or combinations thereof. The housing (8) may be constructed of two or more parts, which may be subsequently mechanically attached to one another, glued together, welded together, or combinations thereof. Alternatively, the housing (8) may be constructed of a single integrally-formed part.

The invention provides that by modulating the compression state of the elastomeric material (3) and, therefore, the ohmic resistance thereof, the amount of electrical power transmitted from the power source to the light source is controlled. Of course, modulating the amount of electrical power transmitted to the light source will serve to modify the luminous intensity of the light emitted therefrom. In the embodiment shown in FIG. 1, for example, the knob (9) may be rotated in a first direction, causing the power source (1) to move forward, which in turn causes the plunger (12) to move forward and compress the elastomeric material (3). This compression of the elastomeric material (3) causes the ohmic resistance thereof to decrease. This decrease in ohmic resistance may allow more current to be transferred to the light source (2), which increases the luminous intensity of the light emitted therefrom. Alternatively, through the use of a DC/DC converter, this decrease in ohmic resistance may ultimately allow less current to be transferred to the light source (2), which decreases the luminous intensity of the light emitted therefrom.

Conversely, in such embodiments, the knob (9) may be rotated in a second (opposite) direction, causing the power source (1) to move backwards, which in turn causes the plunger (12) to move backwards and decompress the elastomeric material (3). This decompression of the elastomeric material (3) causes the ohmic resistance thereof to increase. The increase in the ohmic resistance of the elastomeric material (3) may prevent (or reduce the amount of) current that is transferred to the light source (2), which decreases (or eliminates) the luminous intensity of the light emitted therefrom. Alternatively, through the use of a DC/DC converter, the increase in the ohmic resistance of the elastomeric material (3) may ultimately increase the amount of current that is transferred to the light source (2), which increases the luminous intensity of the light emitted therefrom.

Figure 2:
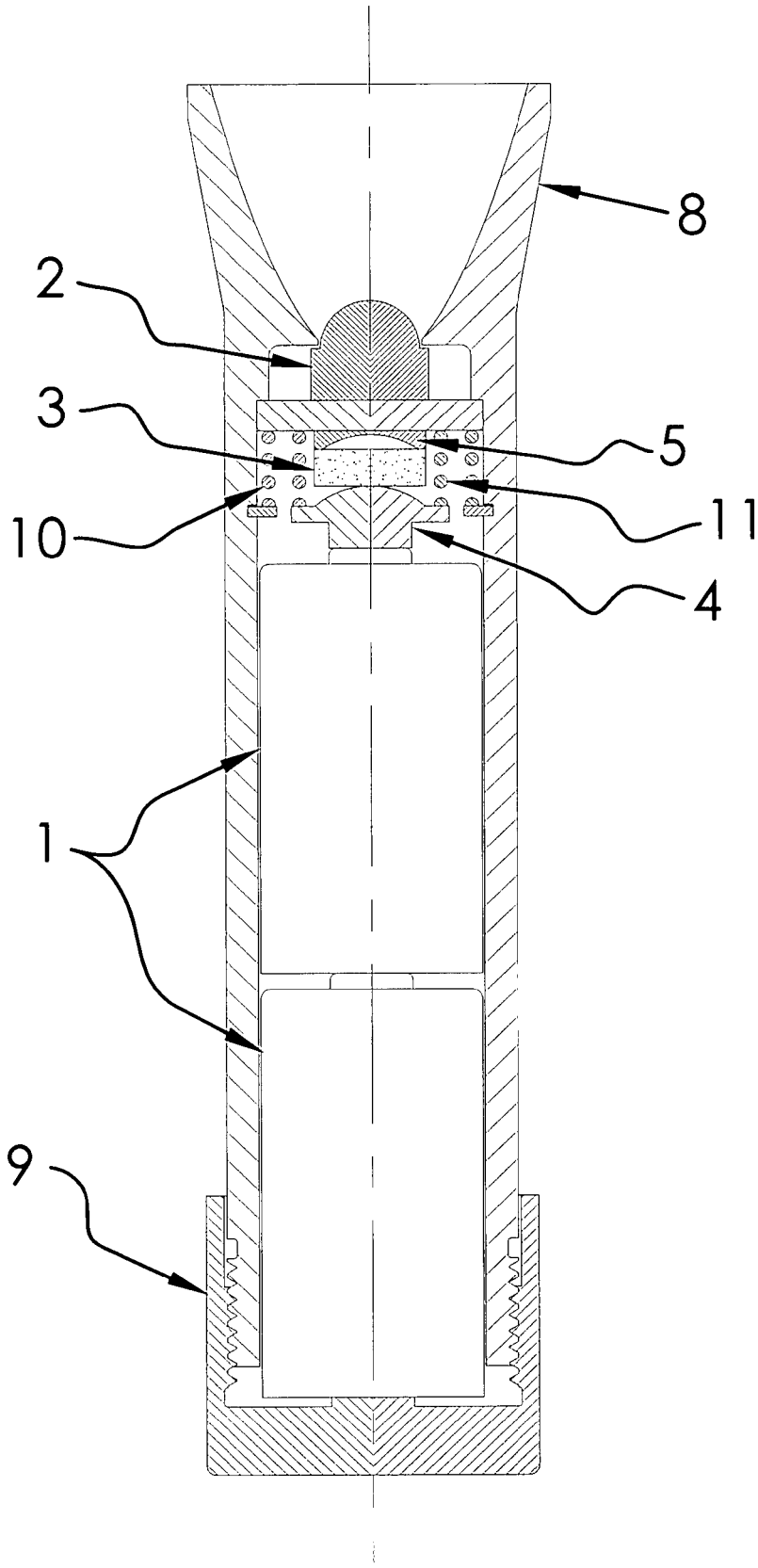
FIG. 2 is a cross-sectional view of another light emitting apparatus employing the devices and methods of the present invention, in which a conductive surface that is operably connected to a light source exhibits a concave shape (relative to the conductive elastomeric material shown therein), which is adapted to receive the conductive elastomeric material in a compressed state.

The invention provides that, in certain embodiments, the conductive surface of the light source (2), or the conductive surface that is operably connected to the light source (2), is configured to increase the surface area that contacts the elastomeric material (3) upon compression thereof, while reducing the surface area that contacts the elastomeric material (3) upon decompression thereof. Referring to FIG. 2, for example, the conductive surface of the light source (5) exhibits a relatively concave configuration—relative to the decompressed elastomeric material (3) shown therein. In such embodiments, the plunger (4) will preferably comprise a corresponding convex-shaped outer surface—relative to the decompressed elastomeric material (3) shown therein. When the plunger (4) is translated forward to compress the elastomeric material (3), the material (3) is compressed and forced to assume the shape of the conductive concave-shaped surface of the light source (5). As such, the ohmic resistance of the material (3) is reduced vis-a-vis compression and an increase in the surface area of contact between the elastomeric material (3) and the conductive surface of the light source (5). The corresponding convex-shape of the plunger (4) selves to facilitate the compression of the elastomeric material (3) and to accommodate the concave-shaped conductive surface of the light source (5).

When the axial force applied by the plunger (4) is removed, the elastomeric material (3) decompresses, returns to its natural resting state, such that it no longer makes contact with a substantial portion of the conductive surface of the light source (5), which is illustrated in FIG. 2. In such decompressed state, the ohmic resistance of the elastomeric material (3) increases substantially, due to the expansion of the material (3) and the significant drop in the amount of surface area thereof which contacts the concave-shaped conductive surface of the light source (5).

Figure 3:
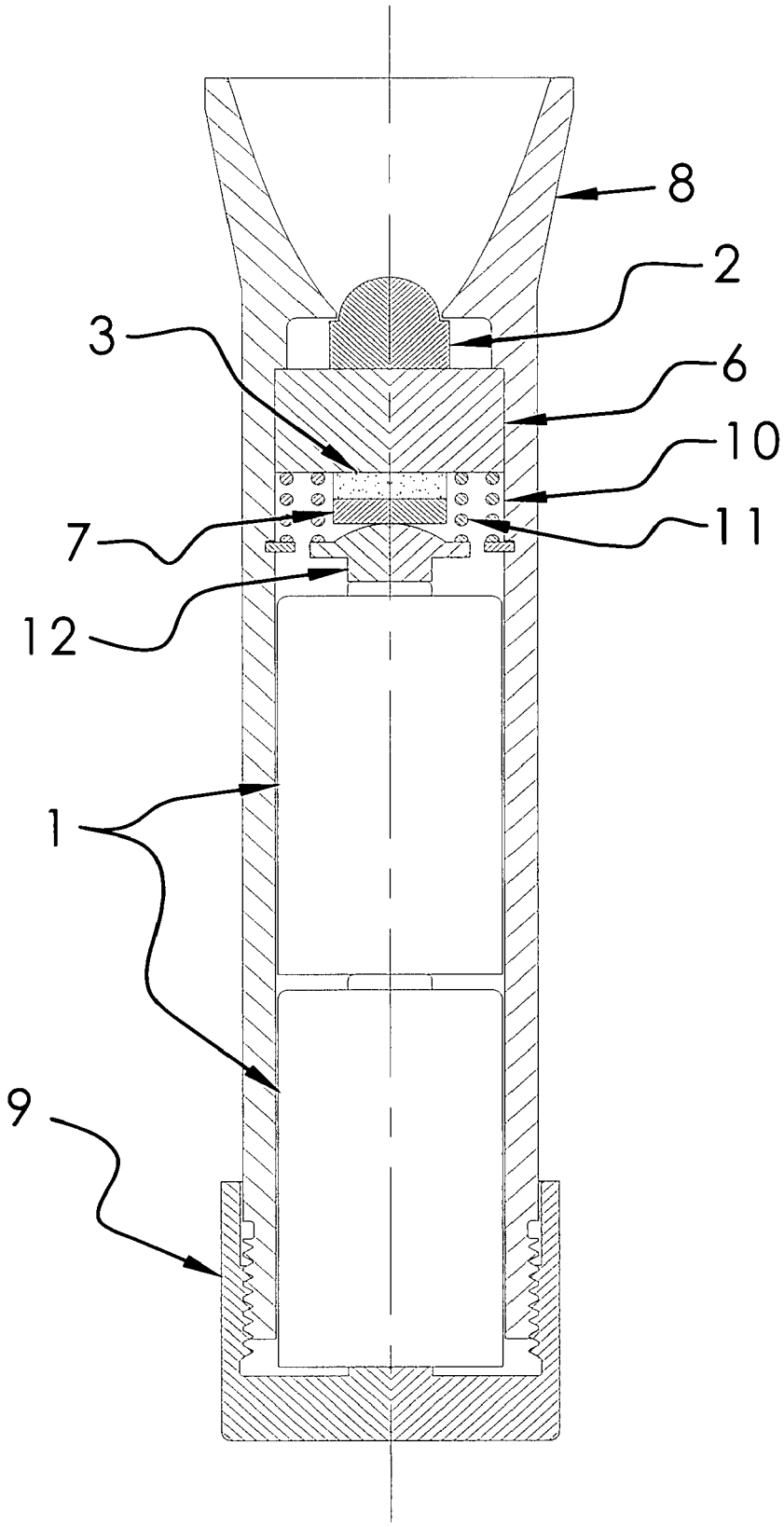
FIG. 3 is a cross-sectional view of yet another light emitting apparatus employing the devices and methods of the present invention, which employs the use of a DC/DC converter circuit and the conductive elastomeric materials described herein to modulate the amount of electrical power transmitted to the light source shown therein.

According to another preferred embodiment of the invention, additional devices for selectively adjusting the luminous intensity of a light source are provided. Such devices are similar to those described above, insofar as they generally comprise a conductive elastomeric material (3), a power source (1), a light source (2), the coil springs (10), (11) described above, and other elements that are described herein relative to other embodiments. In addition to the foregoing, however, the devices may further comprise a DC/DC converter circuit (6). Referring to FIG. 3, for example, the DC/DC converter circuit may be operably connected to the conductive elastomeric material (3), which comprises an electrical resistance that decreases when the material is compressed in response to an axial force applied thereto (and increases when such force is removed and the material is allowed to decompress into its resting state).

As used herein, the term "DC/DC converter circuit" generally refers to a circuit that converts a source of direct current (DC) from one voltage to another. Such converter circuits are well-known in the field of electrical engineering. For example, certain switch-mode DC/DC converter circuits change one DC voltage level to another by temporarily storing the input energy and then releasing that energy to the output at a different voltage. The DC/DC converter circuit may store the input energy using, for example, magnetic elements (e.g., inductors, transformers, and the like) or capacitors. In addition, DC/DC converter circuits are also widely available in the form of integrated circuits, which require little (if any) additional components to operate. Still further, such DC/DC converter circuits are available as a complete hybrid circuit component, such that it may be easily integrated into a light emitting apparatus of the present invention.

Still referring to FIG. 3, the invention provides that by modulating the (compression state) resistance of the elastomeric material (3), one or more operational set points of the DC/DC converter circuit may be controlled. Examples of such operational set points include output voltage, output current, switching frequency, and on/off state (i.e., power "on" and power "off" state, or pulse width modulation ("PWM")). More particularly, the invention provides that a preferred DC/DC converter circuit may include a DC/DC boost converter, such that the variable resistance of the elastomeric material (3) is configured to modulate the output voltage set point of the DC/DC converter circuit. The modulation of the output voltage set point of the DC/DC converter circuit will serve to directly influence the intensity of light emitted from the light source (2). Referring to FIG. 3, according to such embodiments, the device will preferably also include an insulator (7) disposed between the plunger (12) and the DC/DC converter circuit (6). The insulator (7) will serve to isolate the voltage provided by the power source (1) from the elastomeric material (3).

The use of such DC/DC converter circuits in the foregoing embodiments has several advantages. For example, it provides for a more stable energy output at lower voltage levels. In addition, the use of DC/DC converter circuits in this fashion will serve to increase the energy efficiency of the device, insofar as the amount of power dissipated by the elastomeric material (3) is negligible. Still further, the use of these circuits in the present invention will serve to increase the effective life of the power source (1) used in a light emitting apparatus of the present invention, such as a battery employed therein.

According to a further embodiment of the present invention, light sources having selectively adjustable luminous intensities are provided, which employ the devices and methods described herein. Such light sources include, but are not limited to, flashlights and other battery-operated lighting appliances. Still further, the present invention encompasses other lighting appliances that employ the devices and methods described herein, which are provided with electrical power from an external source, whereby the electrical power is temporarily stored within the appliance before it is transmitted to the light emitting element thereof. The invention further provides that any suitable light emitting element may be employed in the present invention, including without limitation light emitting diodes (LEDs), incandescent light bulbs, fluorescent light bulbs, high-intensity discharge lamps, and others.

According to another preferred embodiment of the invention, methods for selectively adjusting the luminous intensity of a light source are provided. In certain embodiments, such methods generally comprise (a) operably connecting a conductive elastomeric material between a power source and light source and (b) selectively compressing or decompressing the conductive elastomeric material. According to such embodiments, compressing the material decreases the electrical resistance thereof and increases (or, through the use of a DC/DC converter, decreases) the electrical power transmitted from the power source to the light source, whereas decompressing the material increases the electrical resistance thereof and decreases (or, through the use of a DC/DC converter, increases) the electrical power transmitted from the power source to the light source. The methods of the present invention may further comprise the use of a plunger to apply or withdraw an axial force to the elastomeric material to compress or decompress the material. In addition, the methods may further comprise the step of exerting a bias force against the plunger, which will preferably operate to prevent the elastomeric material from compressing in a resting state.

The methods of the present invention may further comprise modulating the electrical power that is transmitted to the light source using a conductive elastomeric material described herein, which may be operably connected between a DC/DC converter circuit and a power source. According to such methods, modulating the resistance of the elastomeric material adjusts one or more operational set points of the DC/DC converter circuit, including the output voltage, output current, switching frequency, and on/off state (i.e., power "on" and power "off" state, or pulse width modulation ("PWM")). In such embodiments, by controlling the compression state of the elastomeric material (and, therefore, the ohmic resistance thereof), the one or more operational set points of the DC/DC converter circuit is controlled, which in turn provides a means for controlling the intensity of light emitted from a light source that is operably connected to the DC/DC converter circuit. Preferably, the methods further employ a means for enabling a user of a device incorporating such methods to adjust the compression state of the elastomeric material, such as the rotatable knob and ratchet mechanisms described herein.

While there have been shown and described fundamental features of the invention as applied to preferred embodiments thereof, it will be understood that various omissions and substitutions and changes in the form and details of the methods and devices illustrated and/or described herein, and in their operation, may be made by those of ordinary skill in the art without departing from the spirit of the invention. For example, it is expressly intended that all combinations of those elements and/or method steps which perform substantially the same function in substantially the same way to achieve the same results are within the scope of the invention.

What is claimed is:

1. A device for selectively adjusting the luminous intensity of a light source, which comprises:

(a) a conductive elastomeric material, which is located between a first conductive surface and a second conductive surface;

(b) a power source operably connected to the first conductive surface; and (c) a light source operably connected to the second conductive surface, wherein the conductive elastomeric material comprises an electrical resistance that decreases when said material (i) is compressed or (ii) contacts a greater surface area of the first or second conductive surface.

2. The device of claim 1, which further comprises a plunger capable of imparting an amount of axial force to the elastomeric material.

3. The device of claim 2, which further comprises a means for selectively causing the plunger to increase or decrease the amount of axial force applied to the elastomeric material, wherein increasing or decreasing the axial force applied to the elastomeric material alters the luminous intensity of the light emitted from the light source.

4. The device of claim 3, wherein said means is a rotatable knob or ratchet mechanism.

5. The device of claim 3, wherein the second conductive surface comprises a concave surface that is adapted to receive the elastomeric material in a compressed state, wherein the elastomeric material contacts a greater surface area of the second conductive surface in said compressed state.

6. The device of claim 5, wherein the plunger comprises a convex surface that is adapted to be received by the second conductive surface having a concave surface, wherein the elastomeric material is located in a compressed state between the convex surface of the plunger and concave surface of the second conductive surface.

7. The device of claim 6, which further comprises a spring capable of continuously exerting a bias force preventing the elastomeric material from compressing in a resting state.

8. A device for selectively adjusting the luminous intensity of a light source, which comprises:

(a) a conductive elastomeric material;

(b) a power source;

(c) a light source; and (d) a DC/DC converter circuit, which is operably connected to the conductive elastomeric material, wherein the conductive elastomeric material comprises an electrical resistance that decreases when said material is compressed in response to an axial force applied thereto.

9. The device of claim 8, which further comprises a plunger capable of imparting an amount of axial force to the elastomeric material.

10. The device of claim 9, which further comprises a means for selectively causing the plunger to increase or decrease the amount of axial force applied the elastomeric material, wherein increasing or decreasing the axial force applied to the elastomeric material alters the luminous intensity of the light emitted from the light source.

11. The device of claim 10, wherein said means is a rotatable knob or ratchet mechanism.

12. The device of claim 10, wherein modulating the resistance of the elastomeric material adjusts one or more operational set points of the DC/DC converter circuit.

13. The device of claim 12, wherein the operational set points are selected from the group consisting of output voltage, output current, switching frequency, and on/off state.

14. The device of claim 13, which further comprises an insulator disposed between the plunger and the DC/DC converter circuit.

15. The device of claim 14, which further comprises a spring capable of continuously exerting a bias force preventing the elastomeric material from compressing in a resting state.

16. A method for selectively adjusting the luminous intensity of a light source, which comprises: (a) operably connecting a conductive elastomeric material between a power source and light source and (b) selectively compressing or decompressing the conductive elastomeric material, wherein:

(i) compressing the material decreases the electrical resistance thereof and decompressing the material increases the electrical resistance thereof, and (ii) compressing and decompressing the material alters the amount of electrical power transmitted from the power source to the light source.

17. The method of claim 16, which further comprises causing a plunger to apply or withdraw an axial force to the elastomeric material to compress or decompress the material.

18. The method of claim 17, which further comprises exerting a bias force which prevents the elastomeric material from compressing in a resting state.

19. The method of claim 18, which further comprises modulating the electrical power that is transmitted to the light source through a DC/DC converter circuit, wherein modulating the resistance of the elastomeric material adjusts one or more operational set points of the DC/DC converter circuit.

20. The method of claim 19, wherein the operational set points are selected from the group consisting of output voltage, output current, switching frequency, and on/off state.

* * * * *